US010029832B2

(12) United States Patent
Isogai

(10) Patent No.: US 10,029,832 B2
(45) Date of Patent: Jul. 24, 2018

(54) CONTAINER SEALING DEVICE

(71) Applicant: Tokan Kogyo Co., Ltd., Tokyo (JP)

(72) Inventor: Takamitsu Isogai, Tokyo (JP)

(73) Assignee: Tokan Kogyo Co., Ltd., Tokyo (JP)

( * ) Notice: Subject to any disclaimer, the term of this patent is extended or adjusted under 35 U.S.C. 154(b) by 0 days.

(21) Appl. No.: 15/037,997

(22) PCT Filed: Dec. 3, 2014

(86) PCT No.: PCT/JP2014/081936

§ 371 (c)(1),
(2) Date: May 19, 2016

(87) PCT Pub. No.: WO2015/083724

PCT Pub. Date: Jun. 11, 2015

(65) Prior Publication Data

US 2016/0288967 A1 Oct. 6, 2016

(30) Foreign Application Priority Data

Dec. 6, 2013 (JP) ..... 2013-253687

(51) Int. Cl.
*B65D 41/34* (2006.01)
*B65D 17/44* (2006.01)
(Continued)

(52) U.S. Cl.
CPC ..... *B65D 51/228* (2013.01); *B65D 47/123* (2013.01); *B65D 47/36* (2013.01);
(Continued)

(58) Field of Classification Search
CPC ..... B62D 51/228; B62D 2251/0028; B62D 2251/009; B62D 2251/0015;
(Continued)

(56) References Cited

U.S. PATENT DOCUMENTS 4,111,325 A * 9/1978 Bellamy ..... B65D 51/228 215/232
4,434,904 A * 3/1984 D'Amico ..... B65D 55/02 215/232

(Continued)

FOREIGN PATENT DOCUMENTS

CN 101535143 A 9/2009
FR 2609970 7/1988
WO WO 2007/126062 A1 11/2007

OTHER PUBLICATIONS

International Preliminary Report on Patentability for International Application No. PCT/JP2014/081936 dated Jun. 7, 2016.

(Continued)

*Primary Examiner* — J. Gregory Pickett
*Assistant Examiner* — Gideon Weinerth
(74) *Attorney, Agent, or Firm* — Knobbe Martens Olson & Bear LLP

(57) ABSTRACT

A container sealing device includes a plug-opening mechanism part belonging to the inner plug 10 and the upper lid 20; and the plug-opening mechanism part has an upper-moving plug-opening mechanism A that opens the plug by rotating the upper lid 20 in a direction of loosening the upper lid with respect to the container 1 to thereby separate the separation part 12 from the body part 11 while holding the separation part 12 by a support part provided on an inner side of the upper lid 20; and a lower-moving plug-opening mechanism B that opens the plug by rotating the upper lid 20 in a direction of tightening the upper lid 20 with respect to the container 1 to thereby separate the separation part 12 from the body part 11 while holding the separation part 12 by the support part.

5 Claims, 10 Drawing Sheets

(51) Int. Cl.

| | |
|---|---|
| ***B65D 51/22*** | (2006.01) |
| ***B65D 47/36*** | (2006.01) |
| ***B65D 47/12*** | (2006.01) |
| *B65D 51/18* | (2006.01) |
| *B65D 51/28* | (2006.01) |

(52) U.S. Cl.
CPC ..... *B65D 51/18* (2013.01); *B65D 51/2814* (2013.01); *B65D 2251/009* (2013.01); *B65D 2251/0015* (2013.01); *B65D 2251/0028* (2013.01); *B65D 2251/0087* (2013.01)

(58) Field of Classification Search
CPC ..... B62D 2251/0087; B62D 47/123; B62D 47/36; B62D 51/18; B62D 51/2814; B62D 7/2835; B62D 47/106; B62D 47/122; B62D 47/142
USPC ..... 215/256, 253, 49, 251, 329, 252, 44, 45; 220/277
See application file for complete search history.

(56) References Cited

U.S. PATENT DOCUMENTS 4,793,475 A * 12/1988 Itzel ..... B65D 51/2814 206/219
5,020,683 A * 6/1991 Strassheimer ..... B65D 41/0421 215/354
6,367,640 B1 * 4/2002 Julian ..... B65D 1/0246 215/329
6,422,412 B1 * 7/2002 Sagawa ..... B65D 5/748 220/277
8,235,232 B2 * 8/2012 Isogai ..... B65D 47/0838 215/253
8,496,129 B2 * 7/2013 Isogai ..... B65D 47/0838 215/253
9,862,528 B2 * 1/2018 Isogai ..... B65D 47/36
2001/0015355 A1 * 8/2001 Adams ..... B65D 5/746 220/258.2
2004/0104193 A1 * 6/2004 Yashima ..... B65D 51/18 215/344
2009/0308834 A1 * 12/2009 Isogai ..... B65D 47/0838 215/329
2014/0190973 A1 * 7/2014 Kerman ..... B65D 35/44 220/278
2015/0321798 A1 * 11/2015 Isogai ..... B65D 47/106 215/253
2015/0353247 A1 * 12/2015 Isogai ..... B65D 5/746 215/252
2016/0167849 A1 * 6/2016 Isogai ..... B65D 51/22 215/296
2016/0244224 A1 * 8/2016 Isogai ..... B65D 47/123
2016/0288967 A1 * 10/2016 Isogai ..... B65D 47/36

OTHER PUBLICATIONS

Tamotsu Ebisu, Microfilm of the specification and drawings annexed to the request of Japanese Utility Model Application No. 021421/1974 (Laid-open No. 112544/1975), Sep. 13, 1975.
Dainippon Printing Co., Ltd., Microfilm of the specification and drawings annexed to the request of Japanese Utility Model Application No. 182283/1986 (Laid-open No. 86021/1988), Jun. 4, 1988.
Office Action dated May 2, 2017 issued in Chinese Patent Application No. 201480066641.5.
Extended European Search Report dated May 9, 2017, issued in EP Application No. 14867122.5.

* cited by examiner

CONTAINER SEALING DEVICE

RELATED APPLICATIONS

This application is a U.S. National Phase Application under 35U.S.C. § 371 of International Application PCT/JP2014/081936, filed Dec. 3, 2014, and claims priority to Japanese Patent Application No. JP2013-253687, filed Dec. 6, 2013, the entire content of which is incorporated herein by reference.

TECHNICAL FIELD

The present invention relates to a container sealing device and sore particularly to a container sealing device for causing a part of an inner plug separated to be held by the upper lid after opening of the plug.

BACKGROUND ART

As a known container sealing device used for a container with an inner plug, there is a structure which is provided with the inner plug and an upper lid; and in which a cylindrical part fitted with an opening part of a container and a separation part continuously provided on an inner side thereof via a score are provided in the inner plug (refer to FIGS. 1 and 2 in Patent Literature 1).

In this container sealing device, the upper lid is preliminarily engaged (screwed) with the separation part of the inner plug through, for example, reverse threads, and the separation part of the inner plug is screwed to a connection part of the upper lid by screwing backward the upper lid so as to remove it from the mouth part (forward thread) of the container when the plug is to be opened, whereby the separation part is separated from the cylindrical part of the inner plug and the separation part is held by the upper lid. According to this cap structure, the plug can be easily opened only by loosening the upper lid, and the separated separation part is held by the upper lid, and thus the separation part does not become so-called rubbish and also can be made to function as a seal.

Incidentally, the aforementioned technology is to unseal the plug by loosening it (by rotating the plug counterclockwise thereby fracturing the score provided in the plug) and to remove the upper lid from the mouth part of the container after unsealing the plug. Recently, a type of technology in which the plug is unsealed by tightening the upper lid (rotating the upper lid clockwise thereby fracturing the score provided in the plug) and the upper lid is removed from the container after unsealing the plug by rotating the upper lid counterclockwise has spread in the market, and there is a concern that a user is upset when opening the plug.

CITATION LIST

Patent Literature

PTL 1: International Publication No. WO2007/126062

SUMMARY OF INVENTION

The present invention has been made in view of the aforementioned background art and an object is to provide a container sealing device which can be opened both by loosening and tightening the upper lid.

In order to solve the aforementioned problem, the container sealing device according to the present invention includes (a) an inner plug having a body part disposed integrally at a mouth part of the container and a separation part joined to the body part via a score and forming an opening by being separated from the body part; and (b) an upper lid engaged with the separation part and screwed to the container or the body part so as to cover the inner plug, wherein (c) a plug-opening mechanism part belonging to the inner plug and the upper lid is provided, and the plug-opening mechanism part has (d) an upper-moving plug-opening mechanism that opens the plug by rotating the upper lid in a direction of loosening the upper lid with respect to the container to thereby separate the separation part from the body part while holding the separation part by a support part provided on an inner side of the upper lid; and (e) a lower-moving plug-opening mechanism that opens the plug by rotating the upper lid in the direction of tightening the upper lid with respect to the container to thereby separate the separation part from the body part while holding the separation part by the support part.

According to the above container sealing device, since the plug can be opened by rotation in both directions of the direction of loosening the upper lid and the direction of tightening the upper lid by using either one of the upper-moving plug-opening mechanism and the lower-moving plug-opening mechanism constituting the plug-opening mechanism part, the user is not upset by a plug-opening operation. Note that, after the plug is opened or unsealed, since the separation part is held by the upper lid, the separation part does not become so-called rubbish and can be made to function as, for example, a seal.

In a specific aspect of the present invention, in the aforementioned container sealing device, the support part of the upper lid and the separation part: have projections which extends in a direction substantially perpendicular to an advance direction of the upper lid and which is formed on the support pare and the separation part, respectively; and are engaged with each other by riding over the projections each other; and the projections function at least as the upper-moving plug-opening mechanism. Here, the advance direction means a direction parallel with an axial center of the sealing device. In this case, the upper lid can be loosened, and thus the separation part can be cut off from the body part by trying to pull the separation part by using the engagement between the support part and the separation part. Note that the upper lid can be tightened, and thus the separation part can be cut off from the body part by trying to pushing the separation part by the support part.

Moreover, in another aspect of the present invention, the plug-opening mechanism part serves as the upper-moving plug-opening mechanism and the lower-moving plug-opening mechanism and includes: a first screwing part which is provided between a peripheral part of the upper lid and the container or the body part and which enables attachment/removal of the upper lid; and a second screwing part which is provided between the support part of the upper lid and the separation part of the inner plug and which enables separation of the separation part from the body part in plug-opening; and the second screwing part is in a threading relation opposite to the first screwing part. In this case, loosening of the first screwing part enables tightening of the second screwing part, or tightening of the first screwing part enables loosening of the second screwing part, and in either case, the separation part can be separated from the body part.

Furthermore, in still another aspect of the present invention, in a state before plug-opening, a margin allowing tightening by the first screwing part is provided between the body part of the inner plug and the upper lid. in this case, tightening of the upper lid only for the margin becomes possible, and the plug-opening or unsealing by the lower-moving plug-opening mechanism becomes possible by this tightening.

Moreover, in still another aspect of the present invention, the container sealing device comprises a positioning mechanism, when the inner pug is assembled to the upper lid, the positioning mechanism enables assembling of the inner plug to the upper lid at a predetermined position by increasing a tightening torque in a stage of proximity by a predetermined portion or more. In this case, the upper lid can be installed at an optimal position, and in assembling of the upper lid, trouble like erroneous plug-opening or unsealing by separation of the separation part can be prevented.

Moreover, in still another aspect of the present invention, the positioning mechanism has: a convex part formed on either one of a lower surface of the upper lid and an upper surface of the inner plug; and a concave part formed at a facing spot on the other surface, and a tightening torque is increased by press-fitting the convex part into the concave part.

Moreover, in still another aspect of the present invention, the projection has a barb shape which facilitates pushing of the separation part into the support part rather than pulling out the separation part from the support part. In this case, when the upper lid and the inner plug are combined and set in advance, the inner plug is screwed to the upper lid by allowing the first screwing part to function, and thus the projection having the barb shape of the second screwing part having a reverse threading relation allows pushing of either one of the separation part and the support part into the other, and the separation part can be engaged with the support part by forced screwing between the support part and the separation part.

BRIEF DESCRIPTION OF DRAWINGS

FIGS. 2*a* and 2*b* are cross-sectional views illustrating the container sealing device of the embodiment in a state where an inner plug is locked by the container, in which FIG. 2*a* illustrates the container, the inner plug and an upper lid, and FIG. 2*b* illustrates an essential part in an enlarged manner.

FIGS. 3*a* and 3*b* are cross-sectional views illustrating the container sealing device of the embodiment in a state where the upper lid is screwed with the container, in which FIG. 3*a* illustrates the container, the inner plug, and the upper lid, and FIG. 3*b* illustrates an essential part in an enlarged manner.

FIGS. 4*a* and 4*b* are cross-sectional views illustrating the container sealing device of the embodiment in a state where the upper lid is screwed with the container (a set state of the upper lid), in which FIG. 4*a* illustrates the container, the inner plug, and the upper lid, and FIG. 4*b* illustrates an essential part in an enlarged manner.

FIGS. 5*a* and 5*b* are cross-sectional views illustrating the container sealing device of the embodiment in a state where the upper lid is screwed with the container (the set state of the upper lid), in which FIG. 5*a* illustrates the container, the inner plug, and the upper lid, and FIG. 5*b* illustrates an essential part in an enlarged manner.

FIGS. 6*a* and 6*b* are cross-sectional views for explaining a state (loosening plug-opening) in which a score (notch) is sheared by rotating the upper lid in a direction of loosening the upper lid with respect to the container in the container sealing device of the embodiment, in which FIG. 6*a* illustrates the container, the inner plug, and the upper lid, and FIG. 6*b* illustrates an essential part in an enlarged manner.

FIGS. 7*a* and 7*b* are cross-sectional views for explaining a state (tightening plug-opening) in which the score is sheared by rotating the upper lid in a direction of tightening the upper lid with respect to the container in the container sealing device of the embodiment, in which FIG. 7*a* illustrates the container, the inner plug, and the upper lid, and FIG. 7*b* illustrates an essential part in an enlarged manner.

FIGS. 10*a* and 10*b* are cross-sectional views illustrating at container sealing device of a second embodiment, in which FIG. 10*a* illustrates a container, an inner plug, and an upper lid, and FIG. 10*b* illustrates an essential part in an enlarged manner.

DESCRIPTION OF EMBODIMENTS

[First Embodiment]

Figure 1:
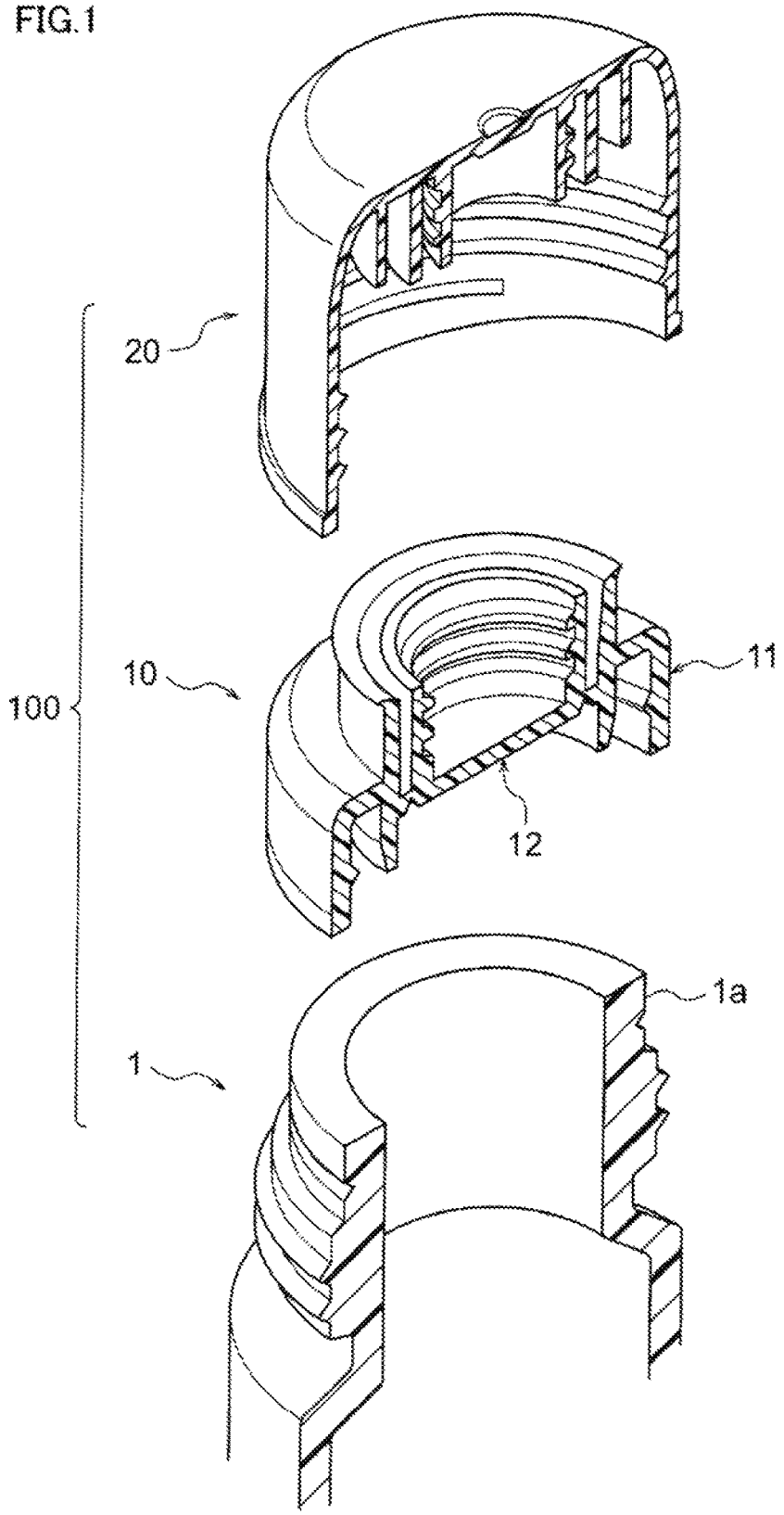
FIG. 1 is an exploded perspective view illustrating a container sealing device according to a first embodiment of the present invention.

FIG. 1 illustrates a container sealing device according to a first embodiment of the present invention. Note that, hereinafter, a positional relation of up and down, or the like will be explained in a state where an axial center of the container is stood vertically.

An illustrated lid assembly (assembly) 100 of a container with an inner plug is constituted by the inner plug 10 locked or fixed to a mouth part 1*a* of a container 1 by fitting or the like and an upper lid 20 screwed to the mouth part 1*a* of the container 1 so as to cover the inner plug 10.

Figure 2B:
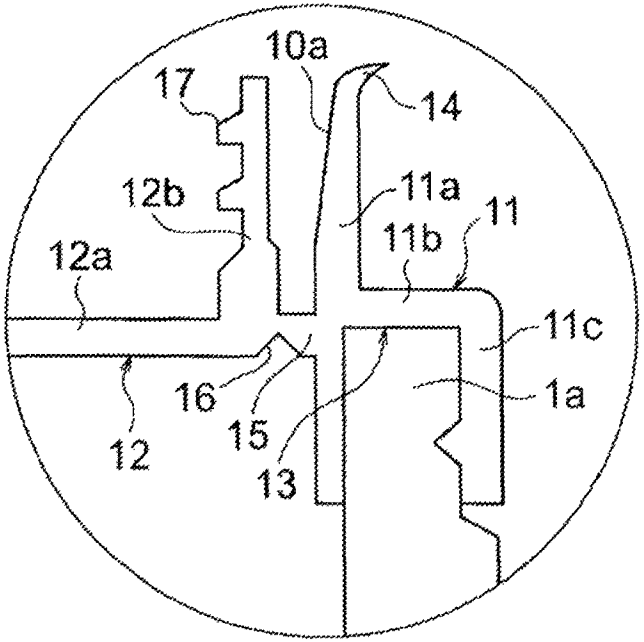
Figure 2A:
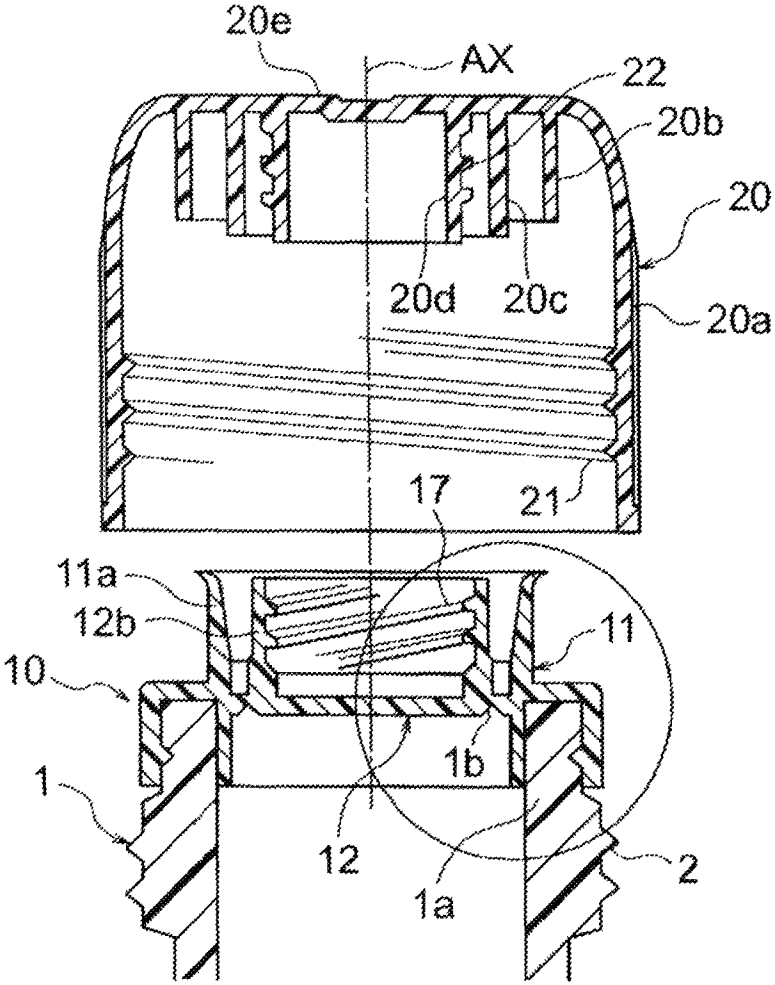
Figure 3B:
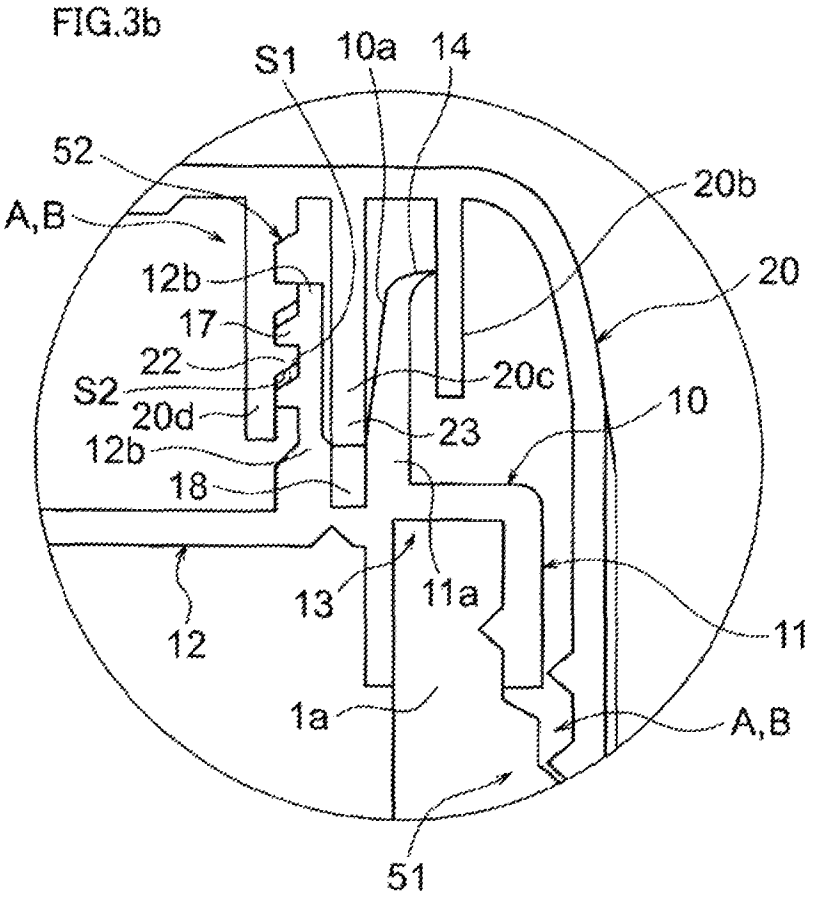
Figure 3A:
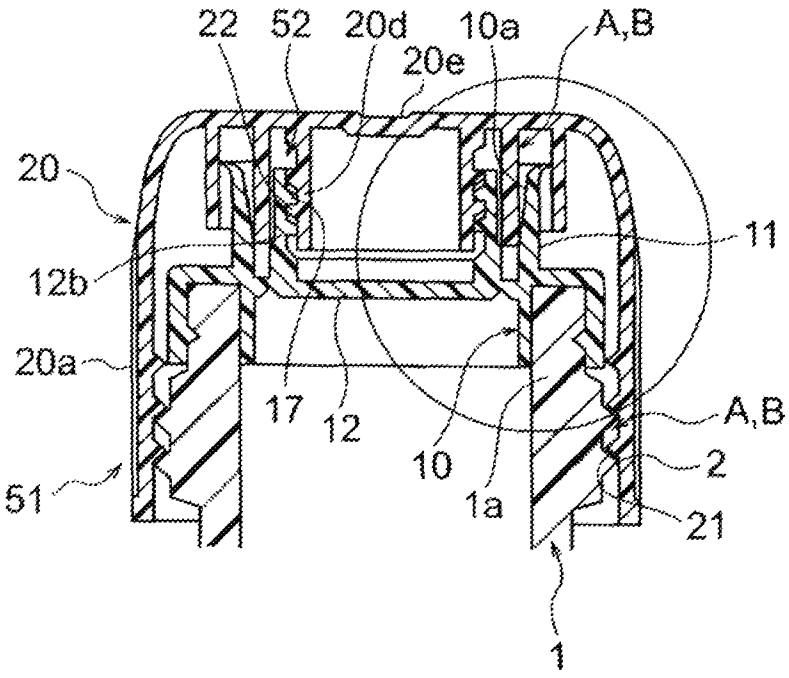

The inner plug 10 is an integrally molded product made of a resin, and as illustrated in FIGS. 2*a* and 2*b*, is provided with a body part 11 to be fitted in the mouth part 1*a* of the container 1 and a separation part 12 which is a part cut off by plug-opening or unsealing. This inner plug 10 is locked to the mouth part 1*a* of the container 1 by the body part 11, for example, after contents are contained in the container 1. Then, as illustrated in FIGS. 3*a* and 3*b*, the upper lid 20 is screwed with the mouth part 1*a* of the container 1, and thus the separation part 12 of the inner plug 10 is engaged with the upper lid 20.

As illustrated in FIG. 2*b* and the like, the body part 11 of the inner plug 10 forms an extraction port 10*a* for the contents of the container 1 and has a cylindrical base part 11*a*, a flange part 11*b* extending outward in a radial direction from an outer peripheral surface of an intermediate part of the cylindrical base part 11*a*, and an annular wall part 11*c* extending downward from an outer end of the flange part 11*b*. The cylindrical base part 11*a*, the flange part 11*b*, and the annular wall part 11*c* define an annular concave part 13 fitted with the mouth part 1*a* of the container 1. Moreover, a lip part 14 expanding to an outer side is formed at an upper end of the cylindrical base part 11*a*.

The separation part 12 of the inner plug 10 is provided with a disc-shaped sealing body 12*a* arranged on a bottom part and a cylindrical part 12*b* having a cylindrical shape extending upward from an outer edge of this sealing body 12*a*. A boundary part on an outer peripheral side between an outer edge of this sealing body 12*a* and a lower part of the cylindrical part 12*b* is connected to the body part 11 of the inner plug 10 by an annular connection part 15. An annular score 16 is formed on a lower surface of the connection part 15. This score 16 is cut off in the plug-opening or unsealing. The cylindrical part 12*b* is arranged away concentrically with the cylindrical base part 11*a* thereinside on the outer side of the cylindrical part 12*b*. There is formed, on an inner peripheral surface of the cylindrical part 12*b*, a female thread 17 which is a projection extending in a direction substantially orthogonal to an advance direction of the upper lid 20 (direction substantially perpendicular to an axial center AX) in the plug-opening. This female thread 17 is screwed with a male thread 22 provided on a small-diameter cylindrical part 20*d* of the upper lid 20 which will be described later.

The upper lid 20 is an integrally molded product made of a resin and is provided with: a cylindrical peripheral wall part 20*a* forming an appearance; a large-diameter cylindrical part 20*b*, a medium-diameter cylindrical part 20*c*, and the small-diameter cylindrical part 20*d* concentrically with the peripheral wall part 20*a* thereinside, and they are continuously provided by a ceiling wall 20*e*. A female thread 21 is formed on a lower end inner peripheral surface of the peripheral wall part 20*a* provided in the peripheral part. This female thread 21 is screwed with a male thread 2 formed on the outer peripheral surface of the mouth part 1*a* of the container 1. Furthermore, a male thread 22 which is a projection extending in a direction substantially orthogonal to the advance direction of the upper lid 20 (direction substantially perpendicular to the axial center AX) is formed on an outer peripheral surface of the small-diameter cylindrical part 20*d* provided on an innermost side. This male thread 22 is screwed with the female thread 17 formed on an inner peripheral side surface of the cylindrical part 12*b* of the separation part 12 provided on the inner plug 10.

As illustrated in FIG. 3*a* and the like, the male thread 2 of the mouth part 1*a* of the container 1 and the female thread 21 of the peripheral wall part 20*a* of the upper lid 20 constitute a first screwing part 51 which enables attachment/detachment of the upper lid 20 with respect to the container 1. Furthermore, the female thread 17 of the cylindrical part 12*b* of the inner plug 10 and the male thread 22 of the small-diameter cylindrical part 20*d* of the upper lid 20 constitute a second screwing part 52 for tightening and fixing the separation part 12 in the inner plug 10 to the small-diameter cylindrical part 20*d* of the upper lid 20. That is, the small-diameter cylindrical part 20*d* of the upper lid 20 functions as a support part for grasping the separation part 12 by the second screwing part 52 and separating the separation part 12 from the inner plug 10. The first screwing part 51 and the second screwing part 52 are in a threading relation opposite to each other. That is, in the case where the first screwing part 51 is screwed back so as to be loosened by rotating the peripheral wall part 20*a* of the upper lid 20 in a counterclockwise direction seen from above, the small-diameter cylindrical part 20*d* of the upper lid 20 is rotated in the counterclockwise direction, and the second screwing part 52 is tightened. Here, a threading direction and the like of, for example, the second screwing part 52 will be described. An upper side of the cylindrical part 12*b* along the axial center AX extends in the threading direction along which screwing is performed by relative rotation in the counterclockwise direction with respect to the small-diameter cylindrical part 20*d* seen from below, whereas a lower side of the cylindrical part 12*b* along the axial center AX extends in a reverse threading direction along which screwing-back is performed by the relative rotation in the clockwise direction with respect to the small-diameter cylindrical part 20*d* seen from below. Furthermore, the lower side of the small-diameter cylindrical part 20*d* along the axial center AX extends in the threading direction along which screwing is performed by rotation in the counterclockwise direction with respect to the cylindrical part 12*b* seen from above, whereas the upper side of the small-diameter cylindrical part 20*d* along the axial center AX extends in the reverse threading direction along which screwing-back is performed by the rotation in the clockwise direction with respect to the cylindrical part 12*b* seen from above. The one obtained by combining the above first screwing part 51 and the above second screwing part 52 functions as a plug-opening mechanism part for opening the plug by separating the separation part 12 from the body part 11 by rotating the upper lid 20 in the direction of loosening or tightening the upper lid with respect to the container 1 when the lid assembly 100 is in an unopened condition.

Note that the female thread 17 formed on the second screwing part 52, that is, on the separation part 12 of the inner plug 10 and the male thread 22 formed on the small-diameter cylindrical pare 20*d* of the upper lid 20 meshed therewith are projections each having a barb shape facilitating pushing of the separation part 12 into the small-diameter cylindrical part 20*d* rather than pulling out the separation part 12 from the small-diameter cylindrical part (support part) 20*d*. Specifically, as illustrated in FIG. 3*b*, the female thread (a projection or a tooth) 17 constituting the second screwing part 52 has an engagement surface S1 with the male thread 22 on the threading side when the separation part 12 is to be displaced upward, the surface S1 is formed to be inclined downward toward an inner side in the radial direction of the inner plug 10, and a thickness of a tip end part is set smaller than the thickness of the base part. On the other hand, the male thread (a projection or a tooth) 22 constituting the second screwing part 52 has an engagement surface S2 with the female thread 17, the surface S2 is formed to be inclined upward toward an outer side in the radial direction of the inner plug 10, although not shown in detail, and the thickness of the tip end part is set smaller than the thickness of the base part. In other words, the female thread 17 of the cylindrical part 12*b* is in a state of being inclined as a whole toward the reverse threading direction or a downward direction along the axial center AX of the inner plug 10 on the basis of a root or proximal side of the thread, and the male thread 22 of the small-diameter cylindrical part 20*d* is in a state of being inclined as a whole toward the reverse threading direction or an upward direction along the axial center AX of the inner plug 10 on the basis of the root side of the thread.

In a state before the plug-opening illustrated in FIG. 3*a* and the like, the upper lid 20 and the inner plug 10 are not fully tightened together, but a margin allowing tightening by the first screwing part 51 is provided. That is, lower end surfaces of the large-diameter cylindrical part 20*b*, the medium-diameter cylindrical part 20*c*, and the small-diameter cylindrical part 20*d* of the upper lid 20 are not in a state of close contact with any portion of the inner plug 10, but are separated from the inner plug 10 as appropriate. Similarly, the tip end of the cylindrical part 12*b* of the inner plug 10 or the lip part 14 is also not in a state of close contact with the ceiling wall 20*e* of the upper lid 20, but is separated away from it as appropriate. As a result, lightening of the upper lid 20 becomes possible only for a portion of the above margin provided between the upper lid 20 and the inner plug 10, and not only the loosening plug-opening by the upper lid 20 but also tightening plug-opening by the upper lid 20 becomes possible by this tightening.

The inner plug 10 and the upper lid 20 are molded as individual components and sequentially assembled to the container 1 as will foe described below.

After the contents are contained in the container 1, the annular concave part 13 of the inner plug 10 is fitted with the mouth part 1*a* of the container 1, and thus the inner plug 10 is locked to the container 1. In this state, as illustrated in FIG. 2*a* and the like, the mouth part 1*a* of the container 1 is fully sealed by the inner plug 10.

Subsequently, the female thread 21 of the upper lid 20 is screwed with the male thread 2 of the container 1. Then, the upper lid 20 lowers while rotating (rotation in the clockwise direction), and as illustrated in FIG. 3*a* and the like, the lip part 14 of the inner plug 10 is brought into sliding contact with the inner peripheral surface of the large-diameter cylindrical part 20*b*, and the female thread 21 of the upper lid 20 is screwed with the male thread 2 of the container 1.

Additionally, the male thread 22 of the small-diameter cylindrical part 20*d* in the upper lid 20 is engaged with the female thread 17 of the cylindrical part 12*b* in the inner plug 10. Here, since the screwing relation between the male thread 22 of the small-diameter cylindrical part 20*d* in the upper lid 20 and the female thread 17 of the cylindrical part 12*b* in the inner plug 10 is in a relation (reverse screwing) opposite to the screwing relation (in case tightening screwing by rotation in the clockwise direction=forward screwing) between the female thread 21 of the peripheral wall part 20*a* in the upper lid 20 and the male thread 2 of the mouth part 1*a* in the container 1, the upper lid 20 is lowered while the stale thread 22 is caused to ride over the female thread 17, that is, the tooth of the male thread 22 and/or the tooth of the female thread 17 are deformed.

Figure 4B:
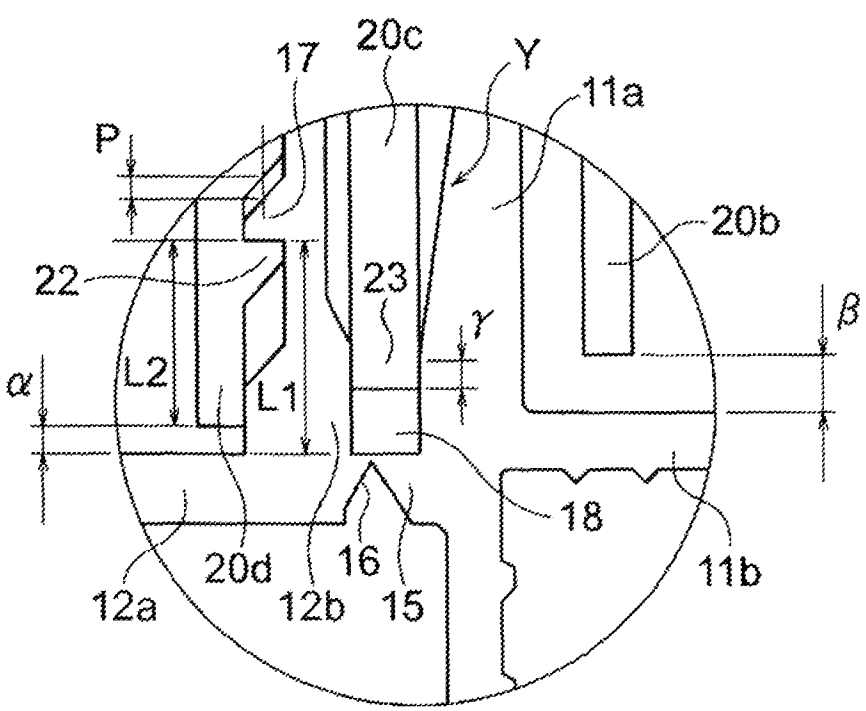
Figure 4A:
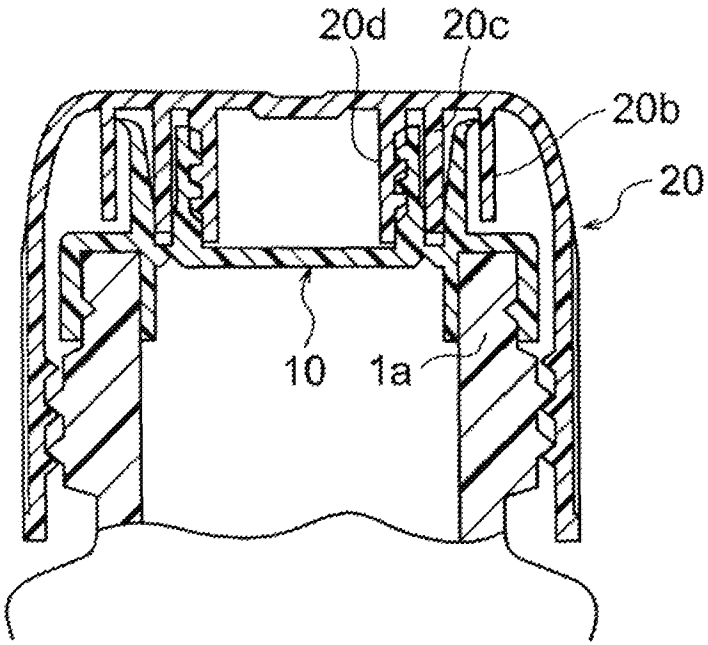

Here, in the embodiment, the female thread 17 of the cylindrical part 12*b* has a shape inclined as a whole toward a direction below the center of the inner plug 10, and the male thread 22 of the small-diameter cylindrical part 20*d* has a shape inclined as a whole toward a direction above the center of the inner plug 10. As a result, the male thread 22 and the female thread 17 can easily ride over by deformation. Then, at timing when the male thread 22 rides over the female thread 17 a predetermined number of times (see FIGS. 4*a* and 4*b*), a tip end part 23 of the medium-diameter cylindrical part 20*c* in the upper lid 20 is inserted/fitted in a concave part 18 defined by the cylindrical base part 11*a* of the inner plug 10 and the connection part 15 of the cylindrical part 12*b*. When the tip end part 23 of the medium-diameter cylindrical part 20*c* in the upper lid 20 is inserted/fitted in the concave part 18 of the inner plug 10, the tip end part 23 is brought into contact with the wall surface of the concave part 18, for example, the inner peripheral surface of the cylindrical base part 11*a* and/or the outer peripheral surface of the cylindrical part 12*b*, whereby a rotation torque (tightening torque) of the upper lid 20 is increased. That is, the medium-diameter cylindrical part 20*c* which is a convex part and the concave part 18 serve as a positioning mechanism Y by which the inner plug 10 assembles the upper lid 20 at a predetermined position, and the rotation torque is increased by press-fitting the medium-diameter cylindrical part 20*c* into the concave part 18. It is confirmed that the upper lid 20 is appropriately engaged with the inner plug 10 in a circulation state before plug-opening by detecting the increase of the rotation torque of this upper lid 20 mechanically or through a human sense. This position is preferably such that, as illustrated in FIG. 4*b*, an interval α between the tip end of the small-diameter cylindrical part 20*d* of the upper lid 20 and the sealing body 12*a* of the inner plug 10 (a distance obtained by subtracting a distance L2 from a contact surface of the male thread 22 to the lower end of the small-diameter cylindrical part 20*a*, from a distance L1 from a contact surface of the female thread 17 meshed therewith to the sealing body 12*a*) is equal to a play P between the female thread 17 of the cylindrical part 12*b* of the inner plug 10 and the male thread 22 of the small-diameter cylindrical part 20*d* of the upper lid 20. Furthermore, an interval β between the tip end of the large-diameter cylindrical part 20*b* of the upper lid 20 and the flange part 11*b* of the inner plug 10 is set to a distance larger than a distance for which the score 16 is fractured by lowering of the upper lid 20 to thereby cause lowering of the separation part 12 in tightening plug-opening by tightening of the upper lid 20, namely, for example, approximately twice the play P.

Figure 5B:
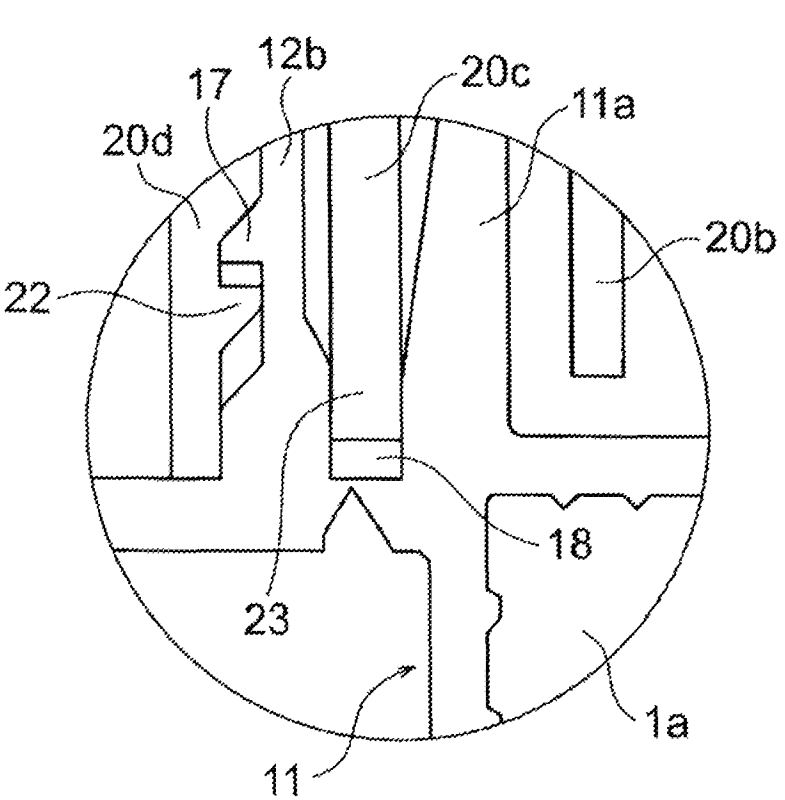
Figure 5A:
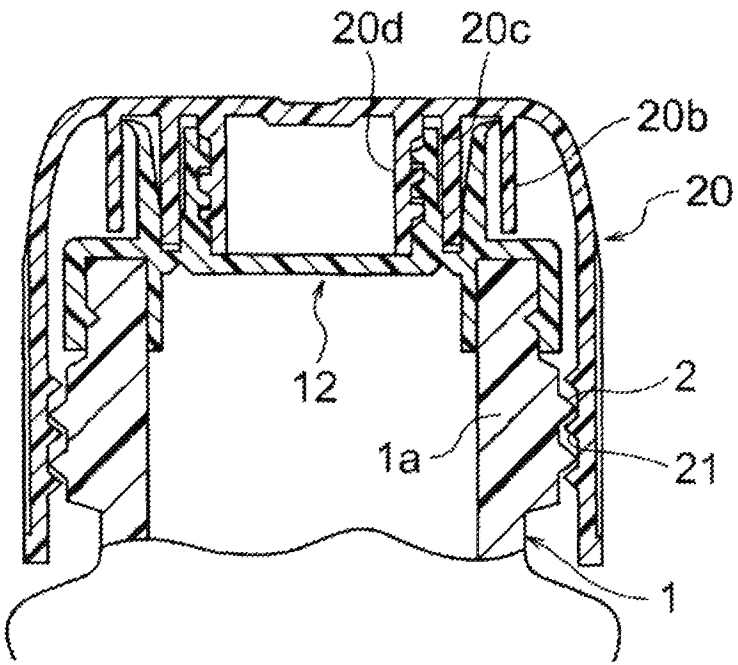

This state is in an initial stage in which the male thread 22 is engaged with the female thread 17, and an engagement part between the male thread 22 and the female thread 17 is slight, and the upper lid 20 is easily rotated with a weak force with respect to the container 1 and the like in some cases. Therefore, in order to make the engagement between the male thread 22 and the female thread 17 more reliable, a further rotation of the upper lid 20 is performed so as to make the engagement between the male thread 22 and the female thread 17 more reliable and to prevent easy rotation of the upper lid 20 (see FIGS. 5*a* and 5*b*).

As described above, on the premise of a state where the inner plug 10 is fully fitted with the mouth part 1*a* of the container 1, the female thread 21 provided on the peripheral wall part 20*a* of the upper lid 20 is screwed with the male thread 2 provided on the mouth part 1*a* of the container 1, and the male thread 22 provided on the small-diameter cylindrical part 20*d* of the upper lid 20 is screwed with the female thread 17 provided on the separation part 12 of the inner plug 10, and thus a product is circulated in a state (circulation state) where the upper lid 20 is tightened to a predetermined set position with respect to the container 1 and the like.

Then, the plug-opening by a consumer or an end user is performed by rotation (rotation in the counterclockwise direction) so as to loosen the upper lid 20 with respect to the container or by rotation (rotation in the clockwise direction) so as to tighten the upper lid 20.

Figure 6B:
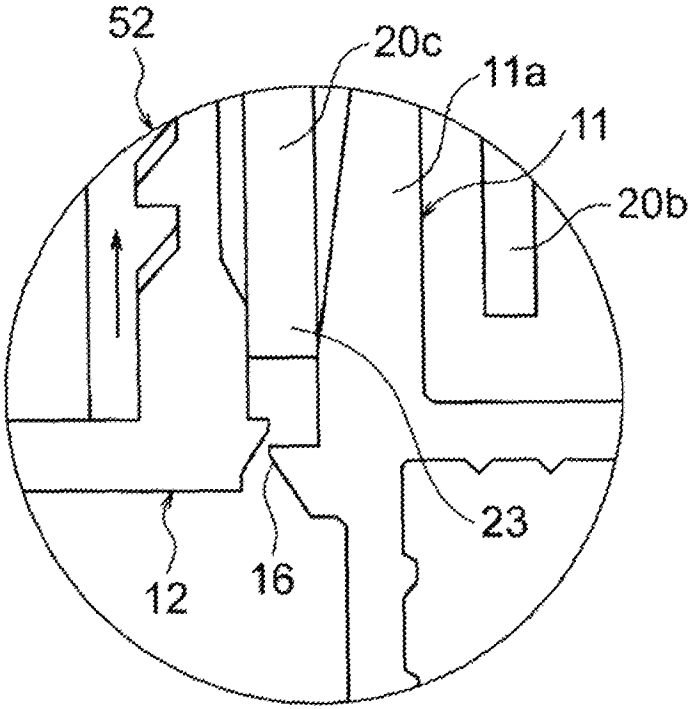
Figure 6A:
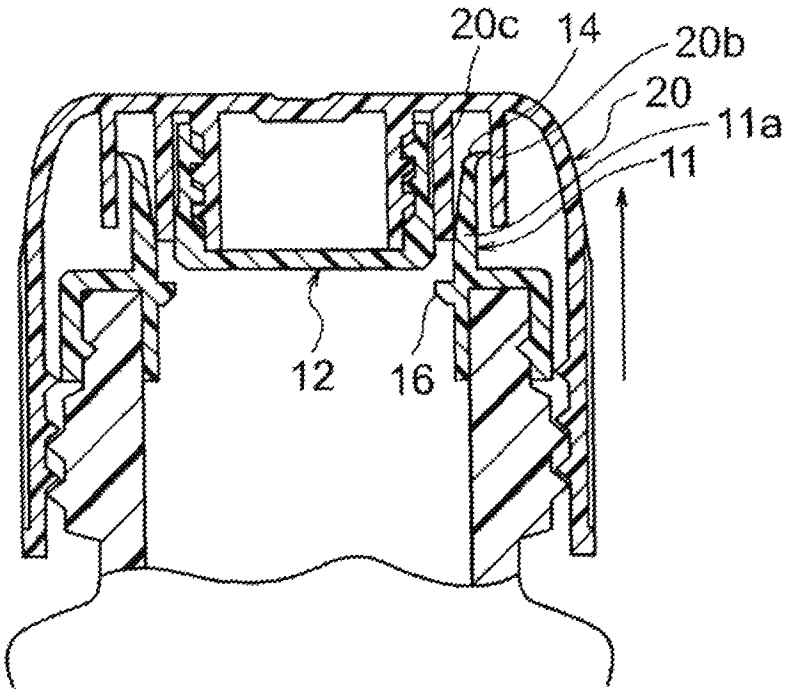

The upper lid 20 is rotated in the loosening direction, that is, in the counterclockwise direction, and thus the upper lid 20 is operated and moved upward so that the second screwing part 52 is tightened as indicated by an arrow in FIG. 6*a*, and tightening of the second screwing part 52 is completed. Along with that, the separation part 12 of the inner plug 10 is forcibly rotated relatively in the counterclockwise direction, sheared at the score 16 and separated from the body part 11 and thus plug-opening (loosening plug-opening) is performed (see FIGS. 6*a*and 6*b*).

Figure 7B:
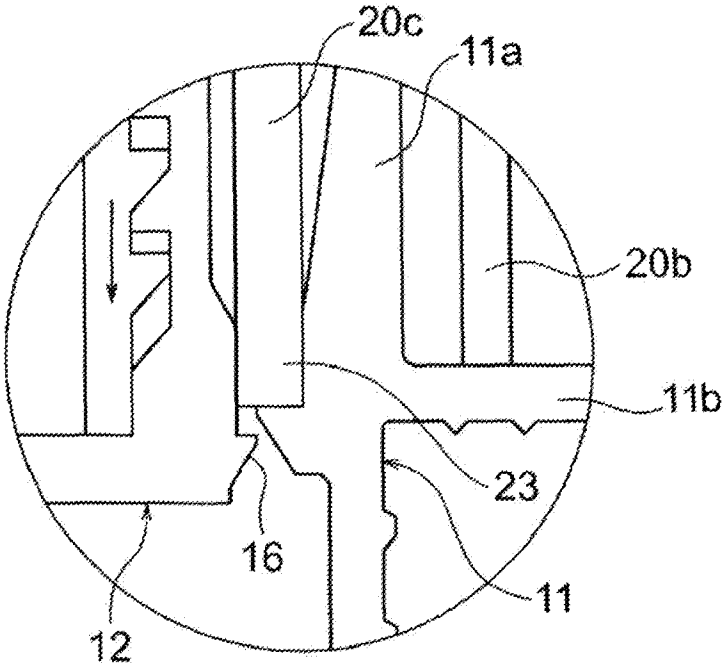
Figure 7A:
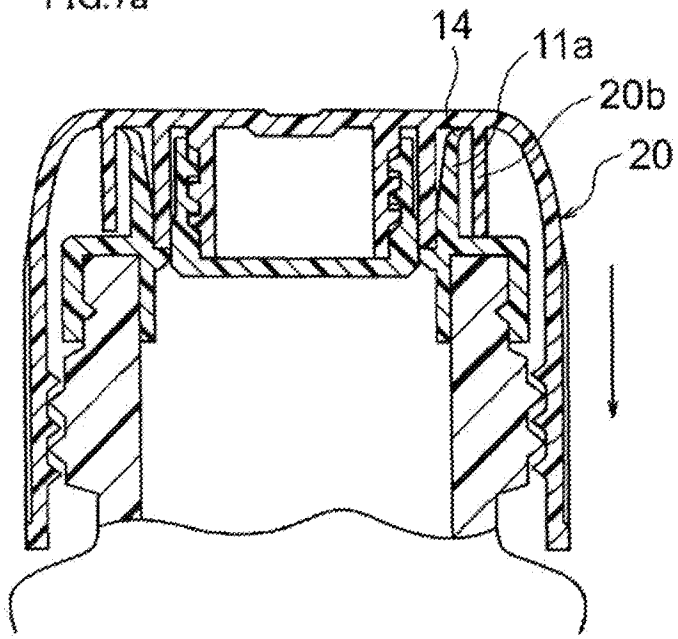

Furthermore, the upper lid 20 is rotated in the tightening direction, that is, in the clockwise direction, the upper lid 20 is moved downward as indicated by an arrow in FIG. 7*a*. Accordingly, the second screwing part 52 is operated so as to be loosened, and the separation part 12 of the inner plug 10 is moved downward, and when this downward movement exceeds a certain limit, the separation part 12 is sheared at the score 16 and separated from the body part 11 to thereby be subjected to plug-opening (tightening plug-opening) (see FIGS. 7*a* and 7*b*). The upper lid 20 is further tightened, and thus the large-diameter cylindrical part 20*b* is brought into contact with the flange part 11*b* of the body part 11 of the inner plug 10, and lowering of the upper lid 20 is limited there.

In the loosening plug-opening or in the tightening plug-opening, a snap sound caused by the fracture of the score 16 is generated, and the torque required for rotation of the upper lid 20 is rapidly decreased, and thus clear opening feeling can be generated.

Figure 8:
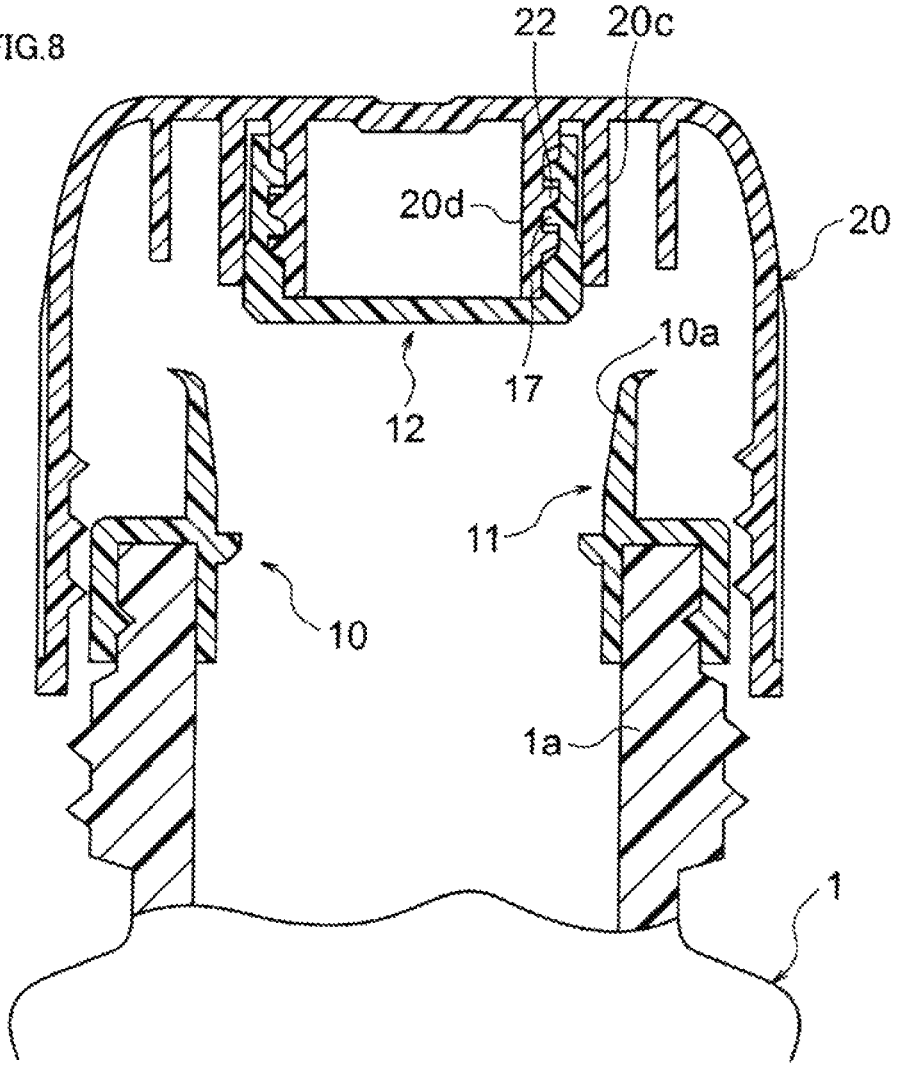
FIG. 8 is a cross-sectional view illustrating a state where the opened upper lid is separated from the container in the container sealing device of the embodiment.

After that, as illustrated in FIG. 8, the separation part 12 of the inner plug 10 is separated from the container 1 in a state of being locked by the upper lid 20, and the extraction port 10*a* of the body part 11 of the inner plug 10 remaining in the container 1 is fully opened. Accordingly, the contents in the container 1 can be poured out.

The separation part 12 after the plug-opening is reliably held by the upper lid 20 by screwing of the male thread 22 of the upper lid 20 and the female thread 17 of the separation part 12 and supplementary sandwiching by the medium-diameter cylindrical part 20*c* and the small-diameter cylindrical part 20*d*.

When the upper lid 20 is screwed to the mouth part 1*a* of the container 1 and tightened after the plug-opening as above, in a state illustrated in FIG. 6*a* or 7*a*, the upper lid 20 is fixed to the container 1. In this state, the tip end part 23 of the medium-diameter cylindrical part 20*c* of the upper lid 20 is brought into contact with the cylindrical base part 11*a* of the body part 11 of the inner plug 10 and furthermore, the lip part 14 of the cylindrical base part 11*a* is brought into contact with the inner peripheral surface of the large-diameter cylindrical part 20*b* or the upper lid 20, whereby the contents in the container 1 are sealed.

As described above, the container sealing device according to the present invention includes an upper-moving plug-opening mechanism A that separates the separation part 12 of the inner plug 10 from, the body part 11 for the plug-opening by rotating the upper lid 20 in the direction of loosening the upper lid 20 with respect to the container 1 and a lower-moving plug-opening mechanism B that separates the separation part 12 from the body part 11 for the plug-opening by rotating the upper lid 20 in the direction of tightening the upper lid 20 with respect to the container 1 (see FIG. 3*b* and the like). Accordingly, since the plug-opening can be performed also in the case of rotating the upper lid 20 in either one of the loosening direction and the tightening direction the upper lid 20 is rotated, the user is not upset during the plug-opening operation.

In addition, in the aforementioned embodiment, as the upper-moving plug-opening mechanism A, the upper lid 20 and the separation part 12 of the inner plug 10 are screwed by reverse thread, while as the lower-moving plug-opening mechanism 8, the upper lid 20 and the separation part 12 of the inner plug 10 are screwed by reverse thread, and the tip end of the medium-diameter cylindrical part 20*c* of the upper lid 20 is brought into contact with the inner peripheral surface of the cylindrical base part 11*a* of the inner plug 10 and/or the outer peripheral surface of the cylindrical part 12*b* of the separation part 12 in order to set the upper lid 20 with respect to the container 1 in a state where there is provided an appropriate interval between the tip end of the large-diameter cylindrical part 20*b* of the upper lid 20 and the flange part 11*b* of the body part 11 of the inner plug 10, whereby a torque is increased by friction resistance.

Figure 9:
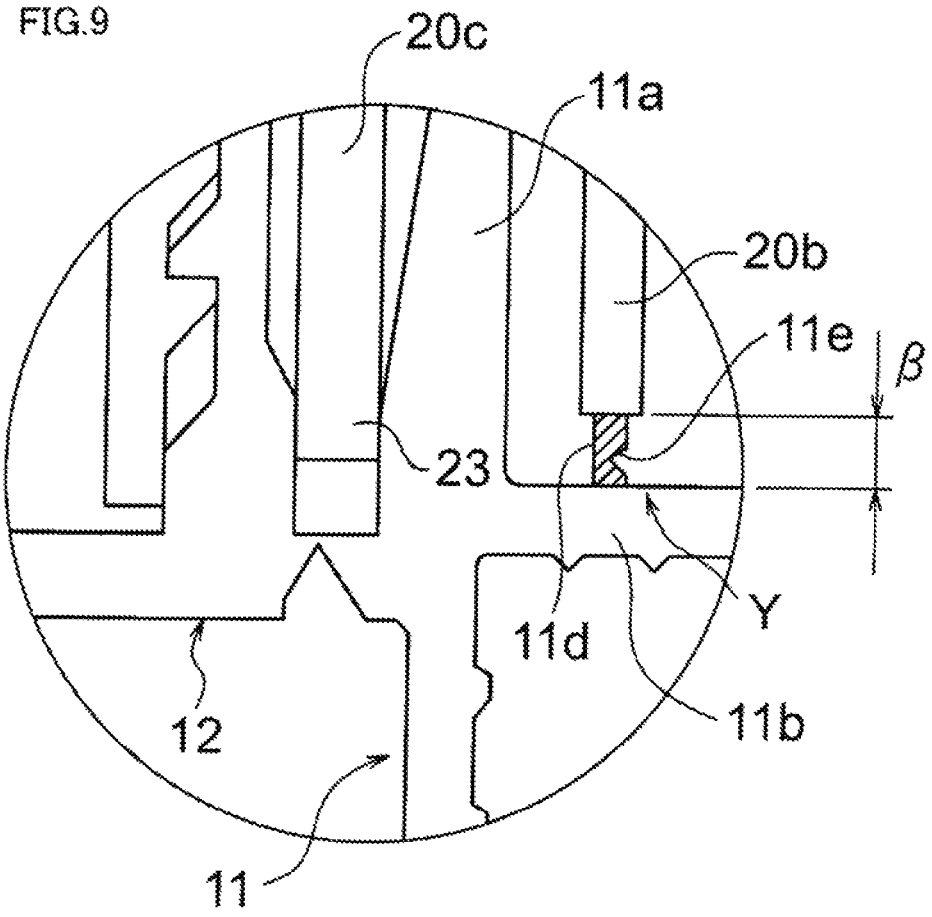
FIG. 9 is a cross-sectional view of an essential part or a modification in which another means for positioning the upper lie at a predetermined position in the container is incorporated.

Note that, in the aforementioned embodiment, a configuration is such that a proper set position of the upper lid 20 with respect to the inner plug 10 can be detected by a torque increase caused by friction resistance between the tip and part 23 of the medium-diameter cylindrical part 20*c* of the upper lid 20 and the body part 11 of the inner plug 10, but the torque can also be increased by other structures. For example, as illustrated in FIG. 9, a convex part lid having a height β is formed on an upper surface of the flange part 11*b* of the inner plug 10 so that the large-diameter cylindrical part 20*b* of the upper lid 20 is received by the convex part 11*d*, whereby the torque is increased, and the convex part 11*d* may be broken or fallen by further tightening of the upper lid 20 in the plug-opening. That is, the large-diameter cylindrical part 20*b* which is a convex part and the convex part 11*d* serve as the positioning mechanism Y by which the inner plug 10 assembles the upper lid 20 at a predetermined position, and contact between the large-diameter cylindrical part 20*b* and the convex part 11*d* increases the rotation torque. In this case, the convex part 11*d* is preferably installed in a distributed manner at plural spots in the periphery along a circumference of the flange part 11*b* in order to facilitate the breakage or the like, or a notch 11*e* or the like is more preferably formed on a peripheral surface.

[Second Embodiment]

Hereinafter, a container sealing device according to a second embodiment will be described. The container sealing device of the second embodiment is a modification of the container sealing device of the first embodiment, and the matters not particularly described are similar to those in the container sealing device in the first embodiment.

Figure 10B:
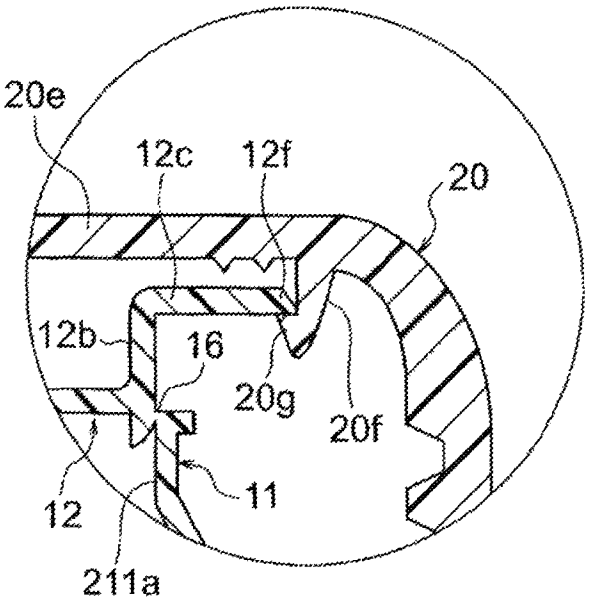
Figure 10A:
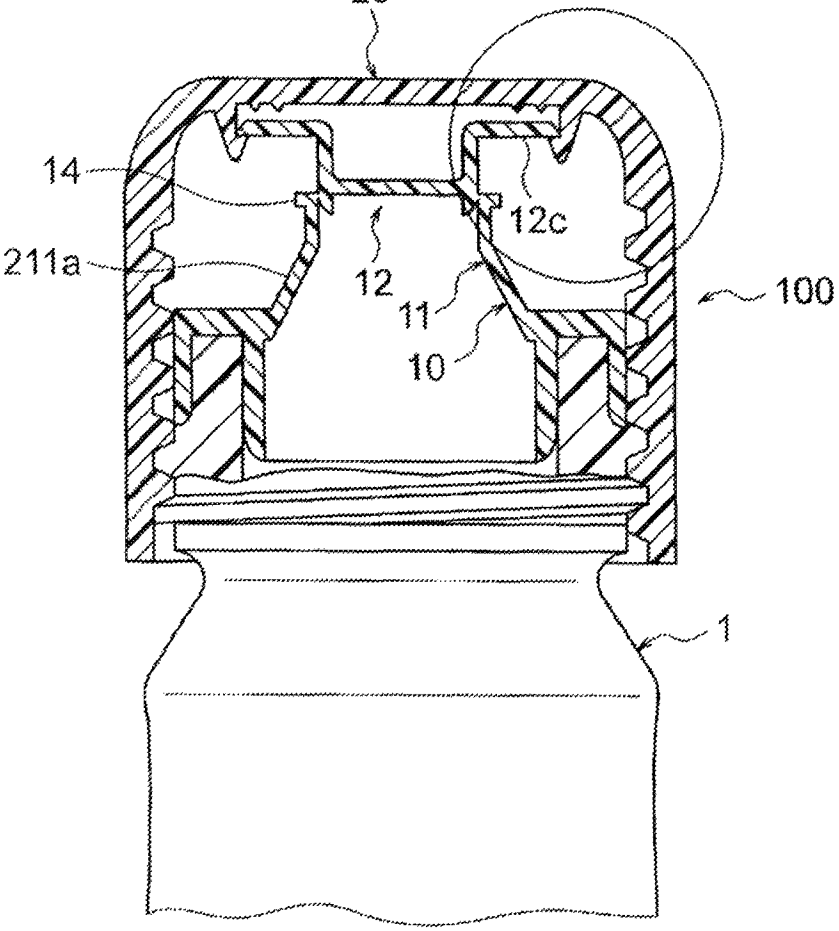

In the lid assembly (assembly) 100 illustrated in FIGS. 10*a* and 10*b*, a flange 12*c* extending outward in the radial direction (a direction orthogonal to the advance direction of the upper lid 20) is formed at an upper end of the cylindrical part 12*b* of the separation part 12 in the inner plug 10, an annular projection 20*f* is formed on a lower surface of the ceiling wall 20*e* in the upper lid 20, and a claw 20*g* projecting inward in the radial direction (a direction orthogonal to the advance direction of the upper lid 20) is formed at a lower end of the annular projection 20*f*.

Then, in the lid assembly 100 illustrated in FIG. 10*a* and the like, when the upper lid 20 is to be screwed with the container 1, the tip end part (projection) 12*f* of the flange 12*c* provided in the inner plug 10 and the claw (projection) 20*g* of the annular projection 20*f* provided on the upper lid 20 are deformed, a space defined by the ceiling wall 20*e*, the annular projection 20*f*, and the claw 20*g* in the upper lid 20 accommodate a peripheral edge part of the flange 12*c* of the inner plug 10. That is, the annular projection 20*f* of the upper lid 20 functions as a support part for grasping the separation part 12 by the flange 12*c* and for separating the separation part 12 from the inner plug 10. As a result, at an upward motion or a downward motion of the upper lid 20, the separation part 12 of the inner plug 10 can follow the motion, and the plug-opening can be achieved by moving the separation part 12 of the inner plug 10 upward/downward along with the upward/downward motion of the upper lid 20 as above.

In the container sealing device of the embodiment, in the circulation state before the plug-opening in the state illustrated in FIG. 10*a* and the like, when the upper lid 20 is rotated in the loosening direction, that is, in the counterclockwise direction, the separation part 12 or the inner plug 10 is held by the annular projection 20*f* and is raised with the upper lid 20, and the separation part 12 and the body part 11 are sheared at the score 16 (loosening plug-opening). In contrast, even when the upper lid 20 is rotated in the tightening direction, that is, in the clockwise direction, the separation part 12 of the inner plug 10 is supported by the ceiling wall 20*e* of the upper lid 20 and is lowered with the upper lid 20, and the separation part 12 and the body part 11 are sheared at the score 16 (tightening plug-opening). After that, when the upper lid 20 is separated from the container 1. by rotation of the upper lid 20 counterclockwise several times, the separation part 12 of the inner plug 10 is also separated from the body part 11 along with that. That is, the contents can be discharged from a cylindrical part 211*a* provided in the body part 11 of the inner plug 10. After use, when the upper lid is screwed with the container 1 by rotation of the upper lid 20 clockwise several times, the separation part 12 of the inner plug 10 is inserted/fitted into the body part 11 along with that and closes the opening.

Note that, also in this container sealing device of the second embodiment, a structure playing a role of a stopper similar to the large-diameter cylindrical part 20*b* of the aforementioned embodiment can be employed.

The present invention is not limited to the aforementioned embodiment but is capable of various modifications. For example, in the above first embodiment, the one obtained by combining the first screwing part 51 and the second screwing part 52 is used as the plug-opening mechanism part, but the second screwing part 52 in them can be replaced by an engagement part constituted of a projection corresponding to the tip end part 12*f* and a projection corresponding to the claw 20*g* of the second embodiment. As a result, the separation part 12 of the inner plug 10 is connected to the small-diameter cylindrical part 20*d* of the upper lid 20, and when the lid assembly 100 is in an unopened condition, the operation of opening the plug by separating the separation part 12 from the body part 11 is made possible by rotating the upper lid 20 in the direction of loosening or tightening the upper lid 20 with respect to the container 1.

Furthermore, in the above first and second embodiments, the upper lid 20 is screwed/joined with the container 1, but a male thread may be formed on the body part 11 of the inner plug 10 to thereby be screwed with the upper lid 20.

Moreover, in the above first and second embodiments, it is presumed that the container 1 has a bottle shape of a PET bottle or the like, but the container 1 may be made of other synthetic resins, glass or metal, or may be a bag-shaped member made of a film and obtained by providing a mouth part, or may be a paper package having a polyhedron shape or the like.

In addition, in the aforementioned embodiment, the tip end part 23 of the medium-diameter cylindrical part 20*c* of the upper lid 20 is provided as a convex part, but a convex part is formed on the upper surface of the inner plug 10 and a concave part is formed at a facing spot on the other surface, and thus the convex part may be press-fitted into the concave part.

What is claimed is:

1. A container sealing device comprising:

an inner plug having a body part disposed integrally at a mouth part of a container and a separation part joined to the body part via a score and forming an opening by being separated from the body part;

an upper lid engaged with the separation part and screwed to the container or the body part so as to cover the inner plug;

a positioning mechanism that enables assembling of the inner plug to the upper lid such that a margin allowing tightening is provided between the upper lid and the inner plug when the inner plug is assembled to the upper lid, wherein the positioning mechanism has: a convex part formed on either one of a lower surface of the upper lid and an upper surface of the inner plug, and a concave part formed at a facing spot on the other surface, and wherein the amount of rotation torque needed to tighten the upper lid is increased by press-fitting the convex part into the concave part; and a plug-opening mechanism part belonging to the inner plug and the upper lid, the plug-opening mechanism part having an upper-moving plug-opening mechanism that opens the inner plug by rotating the upper lid in a direction of loosening the upper lid with respect to the container to thereby separate the separation part from the body part while holding the separation part by a support part provided on an inner side of the upper lid, and a lower-moving plug-opening mechanism that opens the inner plug by rotating the upper lid in a direction of tightening the upper lid with respect to the container to thereby separate the separation part from the body part while holding the separation part by the support part.

2. The container sealing device according to claim 1, wherein the support part of the upper lid and the separation part have projections which extend in a direction substantially perpendicular to an advance direction of the upper lid and which are formed on the support part and the separation part, respectively; and are engaged with each other by riding over the projections of each other; and the projections function at least as the upper-moving plug-opening mechanism.

3. The container sealing device according to claim 2, wherein:

the projections have a barb shape which facilitates pushing of the separation part into the support part rather than pulling out the separation part from the support part.

4. The container sealing device according to claim 1, wherein the plug-opening mechanism part serves as the upper-moving plug-opening mechanism and the lower-moving plug-opening mechanism and includes:

a first screwing part which is provided between a peripheral part of the upper lid and the container or the body part and which enables attachment and/or removal of the upper lid; and a second screwing part which is provided between the support part of the upper lid and the separation part of the inner plug and which enables separation of the separation part from the body part during plug-opening, and wherein the second screwing part is in a threading relation opposite to the first screwing part.

5. The container sealing device according to claim 4, wherein:

in a state before plug-opening, a margin allowing tightening by the first screwing part is provided between the body part of the inner plug and the upper lid.

* * * * *